US010278524B2

(12) United States Patent
Greve

(10) Patent No.: US 10,278,524 B2
(45) Date of Patent: May 7, 2019

(54) HANGER

(71) Applicant: Dean N. Greve, West Bloomfield, MI (US)

(72) Inventor: Dean N. Greve, West Bloomfield, MI (US)

( * ) Notice: Subject to any disclaimer, the term of this patent is extended or adjusted under 35 U.S.C. 154(b) by 28 days.

(21) Appl. No.: 15/187,720

(22) Filed: Jun. 20, 2016

(65) Prior Publication Data

US 2016/0316942 A1 Nov. 3, 2016

Related U.S. Application Data

(63) Continuation-in-part of application No. 14/702,716, filed on May 2, 2015, now abandoned, and a continuation-in-part of application No. 14/722,798, filed on May 27, 2015, now Pat. No. 9,370,267.

(60) Provisional application No. 61/997,327, filed on May 27, 2014.

(51) Int. Cl.
*E04G 3/00* (2006.01)
*A47G 1/16* (2006.01)

(52) U.S. Cl.
CPC ..... *A47G 1/164* (2013.01)

(58) Field of Classification Search
CPC ..... A47G 1/164; A47G 1/24
See application file for complete search history.

(56) References Cited

U.S. PATENT DOCUMENTS 791,060 A * 5/1905 Wallace ..... A47G 1/164 248/475.1
935,797 A 10/1909 Leonard
1,107,686 A 8/1914 Mehrmann
1,196,936 A * 9/1916 Eisass ..... A47G 1/1686 248/495
1,242,309 A 10/1917 Backerud
2,697,572 A 12/1954 Pfankuch
2,975,994 A 3/1961 Goss
3,251,569 A 5/1966 Rynearson
3,914,892 A 10/1975 Mohr
3,945,599 A 3/1976 spier
4,161,977 A 7/1979 Baslow
4,272,047 A 6/1981 Botka
4,549,713 A 10/1985 Magadini
4,557,455 A 12/1985 Benjamin
(Continued)

OTHER PUBLICATIONS

The International Search Report and the Written Opinion of the International Searching Authority for related PCT application No. PCT/US 16/34507.

*Primary Examiner* — Amy J. Sterling

(74) *Attorney, Agent, or Firm* — Great Lakes Intellectual Property, PLLC

(57) ABSTRACT

A hanger, support and other component or system capable of supporting one or more objects is contemplated. The hanger may be configured to provide four-way adjustability sufficient to facilitate adjustably supporting objects after being affixed to a supporting surface and/or to facilitate adjustably supporting objects having a wire or other support member hidden from view or otherwise difficult to orientate relative to a support surface. The hanger may be configured to enable four-way re-positioning in an up, down, left or right direction, optionally while the one or more objects are supported thereon, without requiring removal or manipulation of fasteners anchoring it to a support.

19 Claims, 17 Drawing Sheets

(56) References Cited

U.S. PATENT DOCUMENTS

| | | | | |
|---|---|---|---|---|
| 4,566,665 | A | 1/1986 | Rynearson | |
| 4,611,779 | A | 9/1986 | Leonard, Jr. | |
| 4,641,807 | A | 2/1987 | Phillips | |
| 4,645,165 | A | 2/1987 | Raap | |
| 4,973,021 | A | 11/1990 | Schulte | |
| 5,342,014 | A | 8/1994 | Wilson | |
| 5,484,032 | A | 1/1996 | Li | |
| 5,947,438 | A | 9/1999 | Lemire | |
| 6,003,825 | A | 12/1999 | Abernathy, Jr. | |
| 6,032,915 | A | 3/2000 | Brindisi | |
| 6,062,525 | A * | 5/2000 | Lemire | A47G 1/164 248/475.1 |
| 6,241,210 | B1 | 6/2001 | Brindisi | |
| 6,299,123 | B1 | 10/2001 | Hayde | |
| 6,550,739 | B1 | 4/2003 | Brindisi | |
| 6,663,075 | B2 | 12/2003 | Zuller | |
| 6,666,425 | B1 | 12/2003 | Ferguson | |
| 6,957,797 | B1 | 10/2005 | Strobel | |
| 7,234,671 | B2 | 6/2007 | Avinger | |
| 7,578,492 | B2 | 8/2009 | Darre et al. | |
| 8,376,308 | B2 | 2/2013 | Greve | |
| 8,864,547 | B2 | 10/2014 | Elson et al. | |
| 9,370,267 | B2 * | 6/2016 | Greve | A47G 1/24 |
| 2009/0294616 | A1 * | 12/2009 | Eriksson-Bradley | A47G 1/202 248/305 |
| 2010/0096532 | A1 | 4/2010 | Greve | |
| 2010/0116964 | A1 | 5/2010 | Aleo | |
| 2012/0241583 | A1 | 9/2012 | Potgieter | |
| 2013/0065480 | A1 | 3/2013 | Elson et al. | |
| 2014/0054435 | A1 | 2/2014 | Chatterjea | |
| 2015/0342374 | A1 | 12/2015 | Greve | |

* cited by examiner 12
20
30
34
28
32
22
24
38
40
42
44
TOP

FRONT

SIDE-2

SIDE-1

BACK

BOTTOM

TOP 58
50
60
62
64
74
22
78
72
FRONT 52
54
76
SIDE-1

84
SIDE-2

90
BACK

BOTTOM 82
80
BACK

SIDE-1

34
TOP 20
32
FRONT

BOTTOM

SIDE-2

86
Section B-B
98
96
94
BACK

44
SIDE-1

38
40
B
TOP

24
FRONT

B
88
92
66
BOTOM

SIDE-2

Detail-2

Section A-A

Detail-1

TOP

FRONT

BOTTOM

SIDE-2

SIDE-1

BACK

ISO

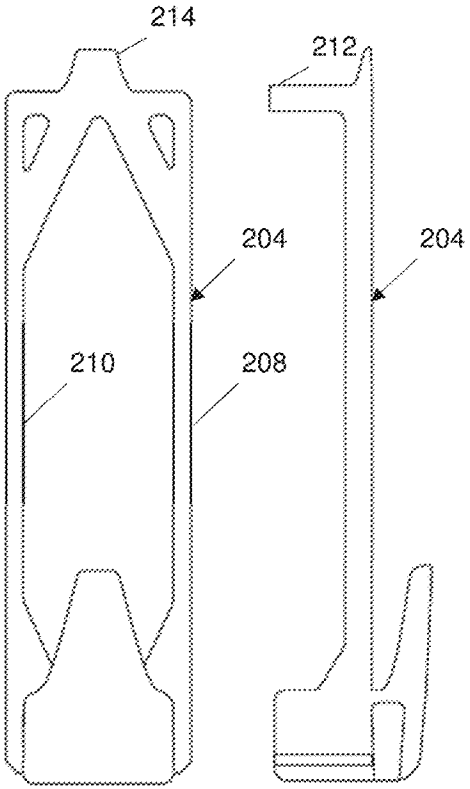
Fig. 13d
Fig. 13c
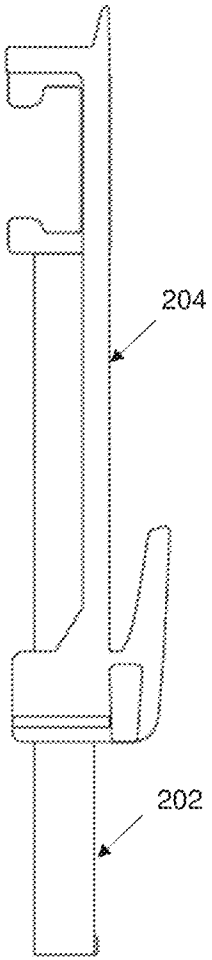
Fig. 13b
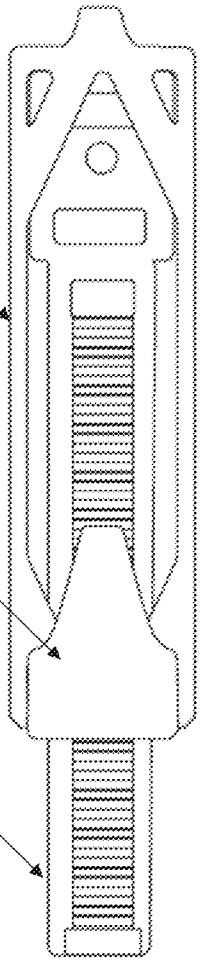
Fig. 13a

HANGER

CROSS-REFERENCE TO RELATED APPLICATIONS

This application claims the benefit of U.S. provisional application No. 61/997,327 filed May 27, 2014, is a continuation-in-part of U.S. application Ser. No. 14/702,716 filed May 2, 2015 and is a continuation-in-part of U.S. application Ser. No. 14/722,798 filed May 27, 2015, the disclosures and benefits of which are incorporated in their entireties by reference herein.

TECHNICAL FIELD

The present invention relates to hangers, supports and other components or systems capable of supporting objects, such as but not necessarily limited to a hanger having adjustability sufficient to facilitate adjustably supporting objects after being affixed to a supporting surface and/or to facilitate adjustably supporting objects having a wire or other support member hidden from view or otherwise difficult to orientate relative to a support surface.

BACKGROUND

A hanger may be broadly characterized as any device, structure, arrangement or the like configured to interface a supported object with a supporting surface. Hangers may be used in any number of environments for any number of purposes to facilitate hanging the supported object relative to the supporting surface in a desired orientation, e.g., it may be desirable to orientate the supported object so as to appear level or at another angle, to appear equally offset from one or more nearby objects, etc. Achieving the desired orientation can be problematic when the hanger attaches to the supporting surface with a fastener or other element in a relatively immovable manner as the re-positioning of the hanger is thwarted unless a user undertakes the arduous task of removing and re-attaching the fastener to another portion of the supporting element. Achieving the desired orientation can also be problematic when the hanger attaches to a wire or other support member of the supported object, particularly if either is hidden from view, as a user may have difficulty predicting the influence or variability associated with the wire and/or the additional influence or variability associated with the hidden support member.

BRIEF DESCRIPTION OF THE DRAWINGS

FIGS. 13*a*-13*f* illustrate a hanger system in accordance with one non-limiting aspect of the present invention.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
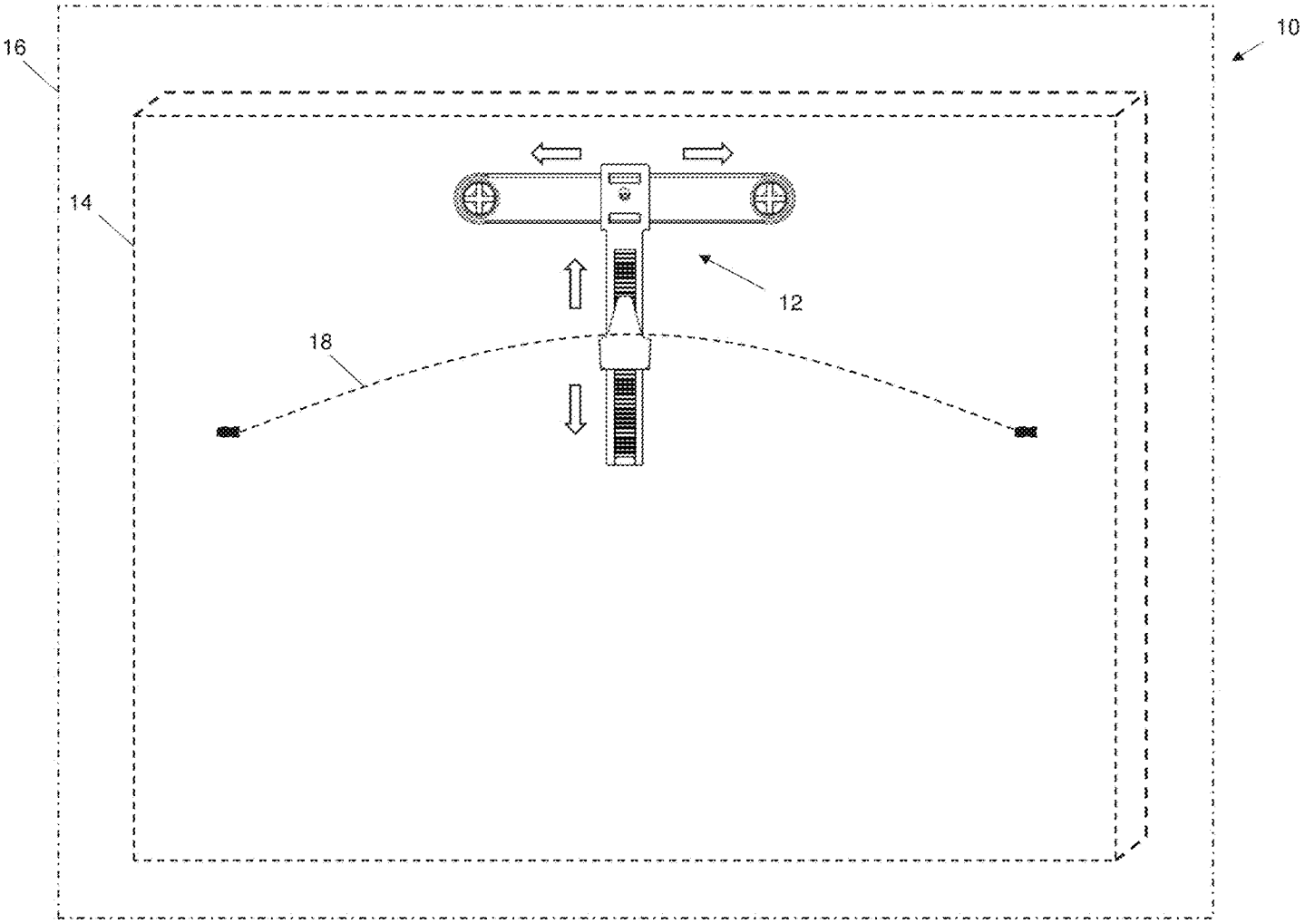
FIG. 1 illustrates a hanging system in accordance with one non-limiting aspect of the present invention.

FIG. 1 illustrates a hanging system 10 in accordance with one non-limiting aspect of the present invention where a hanger 12 is configured to interface a supported object 14 relative to a support or surface 16, such as with retention of a supporting member 18. The present invention is predominately described with respect to use of the hanger 12 to hang a picture for exemplary non-limiting purposes as the present invention fully contemplates its use and application in hanging or otherwise supporting any device(s) of suitable size and shape, optionally with the use of multiple hangers/bars. The hanger 12 may be used to facilitate hanging the supported object 14 relative to the supporting surface 16 in a desired orientation, e.g., it may be desirable to orientate the supported object 14 so as to appear level or at another angle, to appear equally offset from one or more nearby objects, etc. The hanger 12 may be adjustable in four-ways after being affixed to the supporting surface 16 so as to enable a user to easily achieve the desired orientation.

A user may mount a picture 14 to a wall 16 using the hanger 12 and later decide the picture 14 should be adjusted vertically up or down or horizontally left and right. The user may reach behind the supported object 14 to perform the desired adjustment while the supported object 14 is still mounted to the hanger 12 or simply disengage the supported object 14 from the hanger 12 and then perform the desired adjustment. One non-limiting aspect of the present invention contemplates the hanger 12 including a horizontal bar 20, a vertical bar 22 and a carriage 24 arranged to slide-n-glide. The vertical bar 22 may be configured to cooperate with the horizontal bar 20 in a manner sufficient to permit the vertical bar 22 to remain attached while sliding thereon in a first way and a second way from the illustrated center position, i.e., leftward and rightward. The carriage 24 may be configured to cooperate with the vertical bar 22 in a manner sufficient to permit the carriage 24 to remain attached while sliding thereon in a third way and a fourth way from the illustrated center position, i.e., upward and downward.

Figure 2:
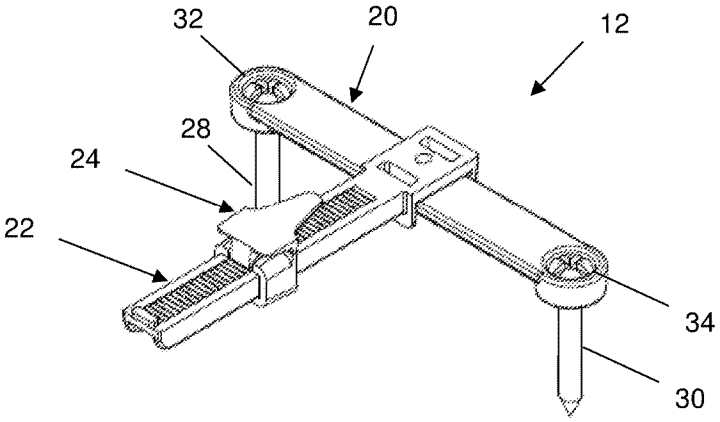
FIG. 2 illustrates a perspective view of the hanger in accordance with one non-limiting aspect of the present invention.
Figure 3:
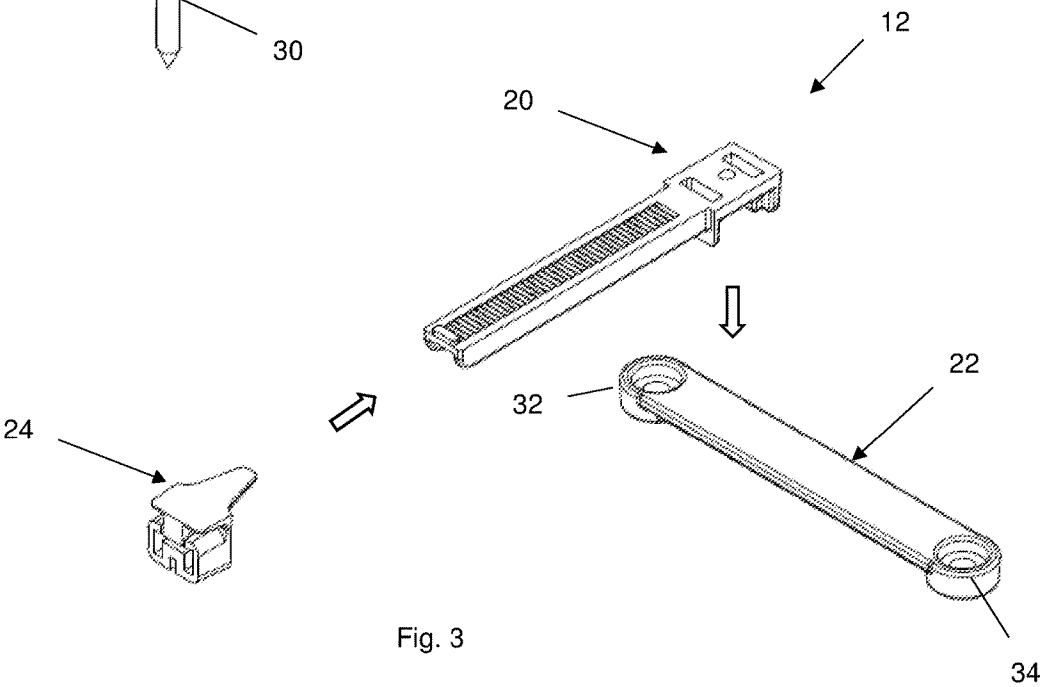
FIG. 3 illustrates an assembly view of the hanger in accordance with one non-limiting aspect of the present invention.
Figures 2, 4A, 4B, 4C, 4D, 4E, 4F:
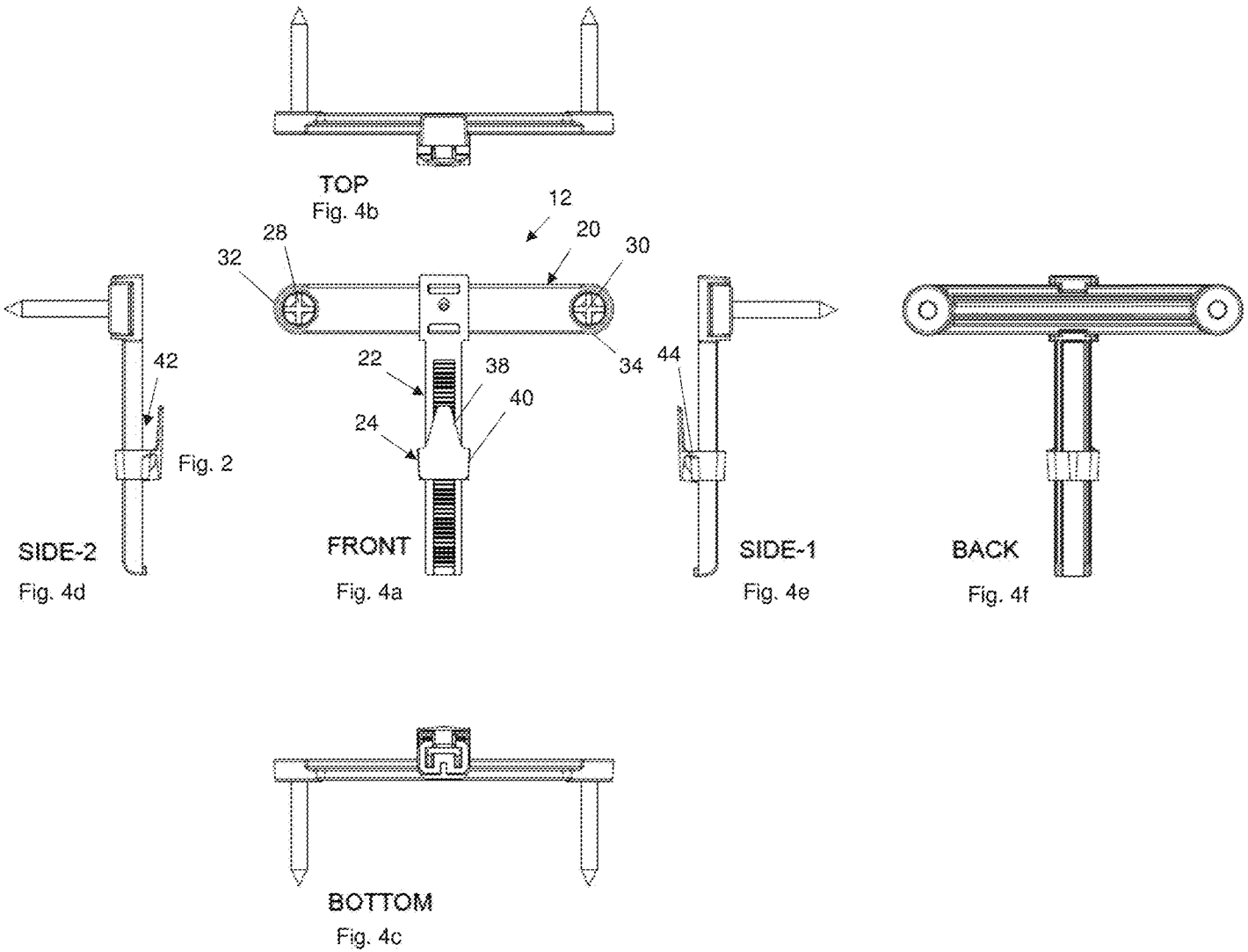
FIGS. 4*a*-4*f* illustrate multiple views of the hanger including the fasteners in accordance with one non-limiting aspect of the present invention.
Figures 5A, 5B, 5C, 5D, 5E, 5F:
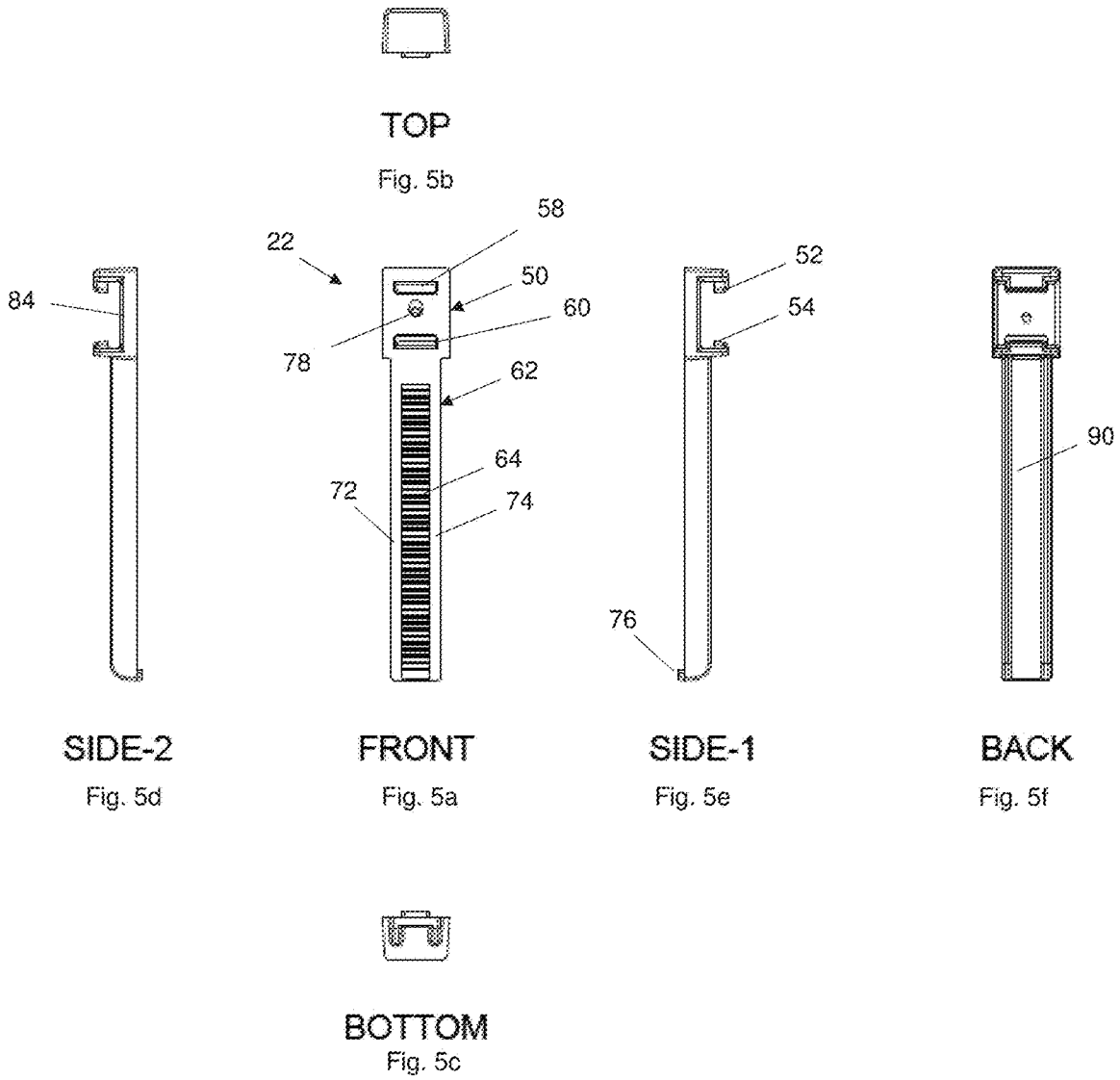
FIGS. 5*a*-5*f* illustrate multiple views of the vertical bar in accordance with one non-limiting aspect of the present invention.
Figures 6A, 6B, 6C, 6D, 6E, 6F:
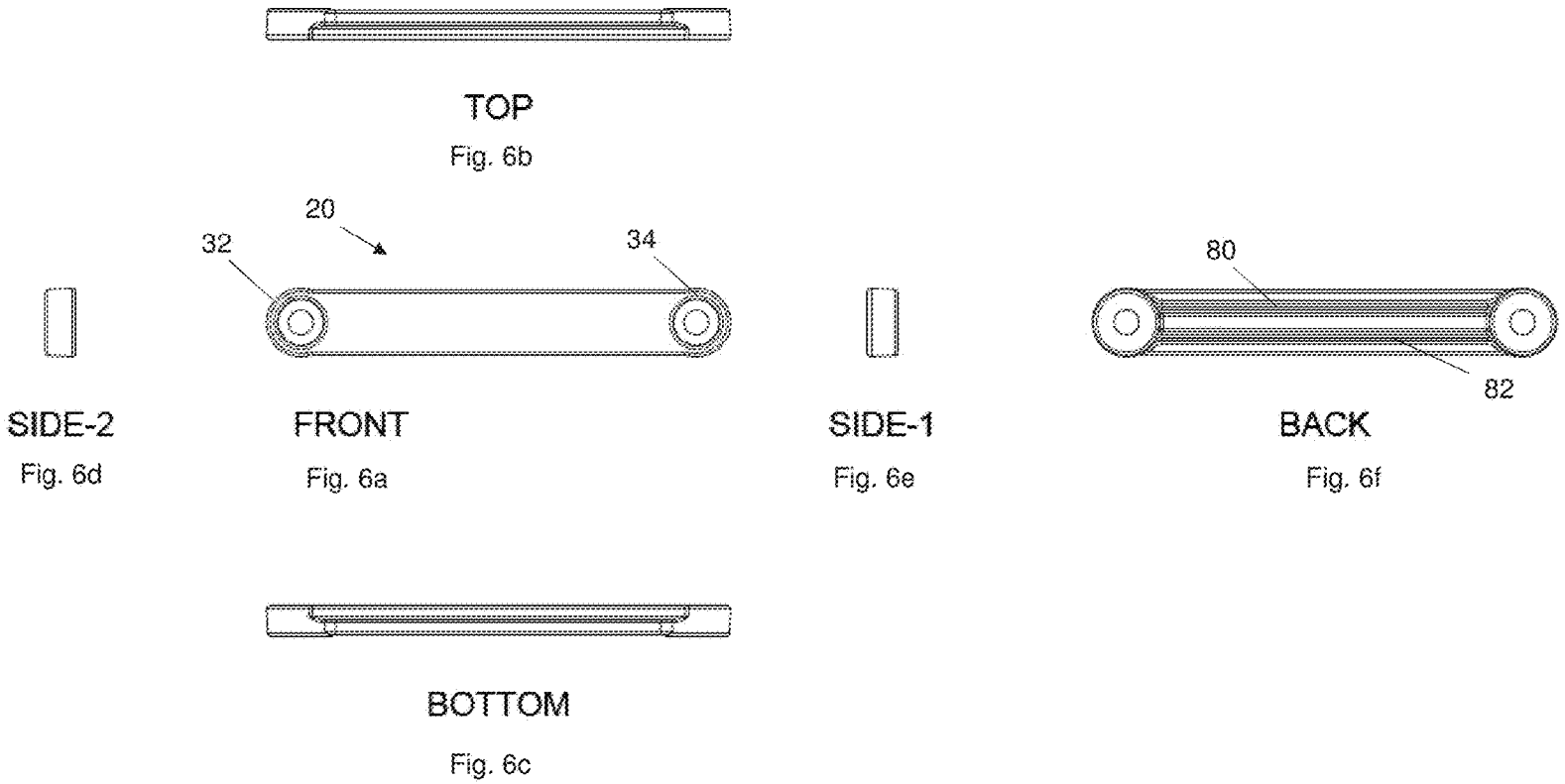
FIGS. 6*a*-6*f* illustrate multiple views of the horizontal bar in accordance with one non-limiting aspect of the present invention.
Figures 7A, 7B, 7C, 7D, 7E, 7F:
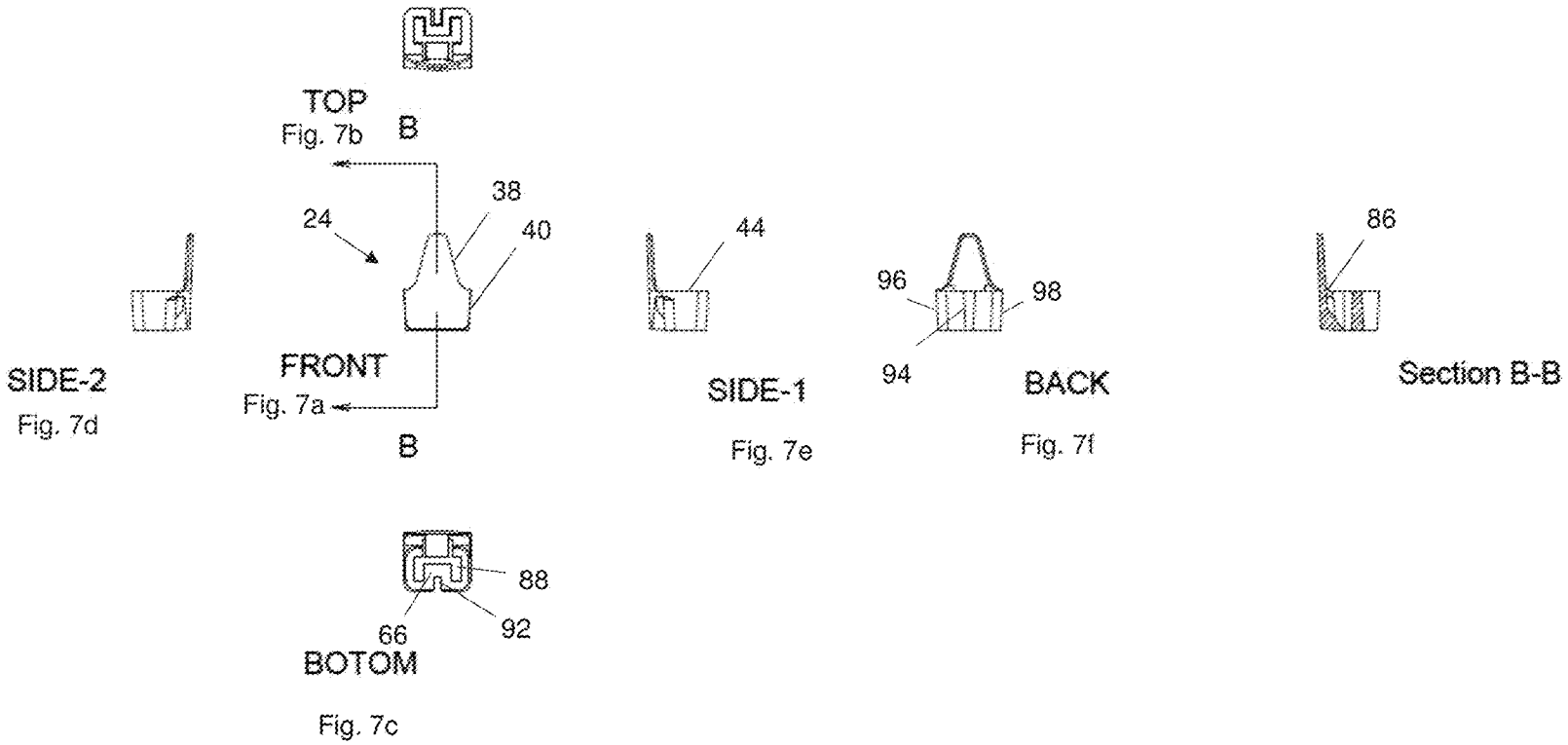
FIGS. 7*a*-7*f* illustrate multiple views of the carriage in accordance with one non-limiting aspect of the present invention.

FIG. 2 illustrates a perspective view of the hanger 12 in accordance with one non-limiting aspect of the present invention. The perspective view illustrates first and second fasteners 28, 30 extending through first and second mounting 32, 34 elements included at distal ends of the horizontal bar 20, which is shown as being elongated but may be shaped in any manner sufficient to facilitate the contemplated four-way adjustability. The first and second fasteners 28, 30 may be nails, screws or other devices suitable to attaching the horizontal bar 20 to the supporting surface, wall, support, structure, etc. FIG. 3 illustrates an assembly view of the hanger in accordance with one non-limiting aspect of the present invention. The assembly view illustrates the hanger 12 without including the first and second fasteners 28, 20 as the hanger 12 may be sold separately from the fasteners 28, 30 and/or operable without the fasteners 28, 30, such as if the supporting surface 16 includes pegs, hooks, pins or other retaining elements upon which the horizontal bar 20 may be sufficiently retained or anchored.

FIGS. 4*a*-4*f* illustrate multiple views of the hanger 12 including the fasteners 28, 30 in accordance with one non-limiting aspect of the present invention. The assembly views illustrate the carriage 24 including a flange 38 configured to cooperate with a guide 40 in a manner sufficient to create a gap or pocket 42 within which the supporting member or other retainer 18 of the supported object 14 may be retained for support. In the case of the wire, supporting member 18 shown in FIG. 1, the wire 18 may rest on a top surface or ledge 44 of the carriage 24 and be prevented from moving forwardly by the flange 38 and backwardly by the vertical bar 22. The top surface 44 is shown to be flat or relatively planar for exemplary purposes and may be sized or shaped differently to match the supporting member 18 or to otherwise provide a corresponding support without deviating from the scope and contemplation of the present invention. The guide 40, for example, may include a recess, aperture, cavity, clip, lock or other element on the top surface 44 to enhance retention of the supporting member 18, including retaining the supporting member 18 at a center of the top surface 44 or otherwise away from the flange 38 so as to limiting outward forces on the flange 38.

FIGS. 5*a*-5*f* illustrate multiple views of the vertical bar 22 in accordance with one non-limiting aspect of the present invention. The vertical bar 22 is shown to include a top portion 50 having first and second lips 52, 54 configured to snap over or otherwise clip the vertical bar 22 to the horizontal bar 20 in a manner sufficient to permit the vertical bar 22 to remain attached while sliding leftward and rightward thereon. The vertical bar 22 is shown to include the first and second lips 52, 54 for exemplary purposes as one of the lips 52, 54 may be removed and/or other configurations may be utilized for achieving similar movement and retention relative to the horizontal bar 20 without deviating from the scope and contemplation of the present invention, e.g., the bottom lip 54 may be replace with a flat or non-clipping surface sufficient to rest against a bottom side of the horizontal bar 20 without being clipped thereto while still facilitating the four-way adjustability contemplated herein. Apertures 58, 60 may be included proximate the lips 52, 54 to facilitate flexing when being snapping to the horizontal bar 20 and/or to facilitate molding or other manufacture of the top portion 50. The vertical bar 22 may include a body portion 62 below the top portion 50 having a plurality of engagement elements 64 operable with the carriage 24 to facilitate securely positioning the carriage 24 at a desired position. The vertical bar 22 is shown as being elongated but may be shaped in any manner sufficient to facilitate the contemplated four-way adjustability.

The plurality of engagement elements 64 are shown for exemplary non-limiting purposes as being recessed grooves position on a front side of the vertical bar 22. The grooves may be teeth, transverse ridges or other elements capable of providing a mating engagement with a pawl 66 (see FIGS. 7*a*-7*g*) sufficient to obstruct the carriage 24 from moving downward therefrom when properly seated. Flat surfaces or rails 70, 72 may be included on opposite sides to the engagement elements 64 to facilitate sliding the carriage 24 thereon. The engagement elements 64 are shown to be recessed or flush relative to the flat surfaces 72, 74 for exemplary non-limiting purposes as the present invention fully contemplates the use of other engagement elements 64, such as but not necessary limited to non-recessed ledges or protuberances extending outwardly beyond the flat rails 72, 74. An end stop or other in larger element 76 may be included at a bottom end of the body portion 62 to limit removal of the carriage 24 as described below in more detail. An aperture 78, optionally diagonally shaped and/or recessed, may be included in the top portion 50 to facilitate receiving a fastener, such as in the manner described in capital U.S. Pat. No. 8,376,308, the disclosure, use and operation thereof is hereby incorporated by reference in its entirety herein.

FIGS. 6*a*-6*f* illustrate multiple views of the horizontal bar 20 in accordance with one non-limiting aspect of the present invention. The horizontal bar 20 may include first and second spines 80, 82 extending in an elongated fashion between the first and second mounting elements 32, 34. The spines 80, 82 may be offset from the top and bottom surfaces to permit or provide clearance for the first and second lips 52, 54 of the vertical bar 22 to snap thereto. A back of the spines 80, 82 may be planar with a back of the first and second mounting elements 32, 34 and cooperatively shaped so as to press against the support surface 16 when mounted while also providing clearance sufficient to permit the vertical bar 22 to slide thereon (see FIGS. 4*a*-4*f*). A height and depth of the first and second lips 52, 54, i.e., an offset of the first and second lips 52, 54 from a central portion 84 (see FIGS. 5*a*-5*f*) of the top portion 50, may be cooperatively shaped with thicknesses of the top and bottom surface of the horizontal bar 20 to allow the vertical bar 22 to rotate slightly when the carriage 24 is loaded so as to cause a bottom end of the vertical bar 22 to press against the supporting surface 16.

The use of two spines 80, 82 is illustrated for exemplary non-limiting purposes as the dual-spine configuration may be beneficial in enhancing structural integrity and rigidity of the horizontal bar 20, including thwarting sagging between the first and second mounting elements 32, 34 when bearing a weight of the supported object 14. A single spine or other configuration may be utilized without deviating from the scope and contemplation of the present invention, including eliminating the spines altogether and/or using protuberances or other non-continuous elements. The first and second mounting elements 32, 34 are shown as recessed apertures shaped to receive a fastener 28, 30 and to counter-sink a head or other end of the fasteners 28, 30 below a front surface of the horizontal bar 20 so as to prevent the fasteners 28, 30 from contacting the supported object 14. The first and second mounting elements 32, 34 and/or the structures associated therewith may define a range of travel of for the vertical bar 22 or the leftward and rightward adjustability contemplated by the present invention. The shapes and sizes thereof may be cooperatively designed so as to prevent the vertical bar 22 from sliding off of a distal end of the horizontal bar 20 once snap thereto, i.e., the first and second lips 52, 54 may abut one of the first and second mounting elements 32, 34 when a maximum travel distance is reached so as to prevent sliding off.

FIGS. 7*a*-7*f* illustrate multiple views of the carriage 24 in accordance with one non-limiting aspect of the present invention. The carriage 24 is shown to include the flange 38 pivotally connected to the guide 40 with a hinge 86. The guide 40 may be formed of a unitary or integral material, such as but not necessary limited to a nylon, a plastic, a polymer or any other suitable material, whereby the hinge 86 may be a living hinge or other feature associated with bending or flexing of the material forming the carriage 24. The flange 38 may include the pawl 66 configured to pivot about the guide 40 so as to facilitate selectively engaging and disengaging relative to any one of the plurality of engagement elements 64. The pawl 66 may be cooperatively sized and shaped with the engagement elements 64 or the recesses associated therewith to provide smooth engagement and disengagement. The engagement elements 64 may be configured in sawtooth pattern or other pattern such that upward movement of the carriage 24 causes the pawl 66 to automatically disengage to permit re-positioning.

Figure 8B:
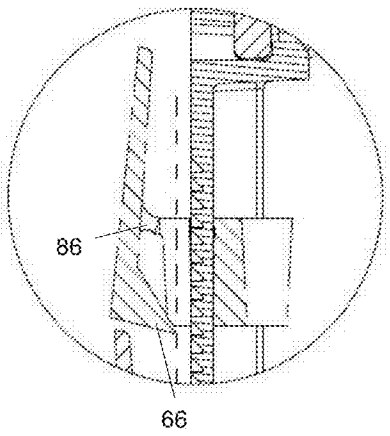
FIGS. 8*a*-8*c* illustrate operation of the carriage in accordance with one non-limiting aspect of the present invention.
Figure 8A:
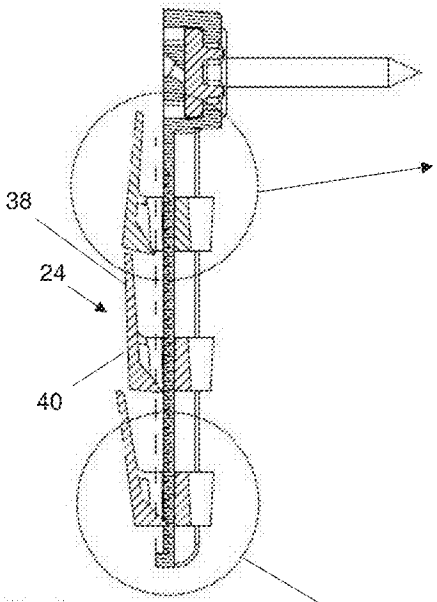
Figure 8C:
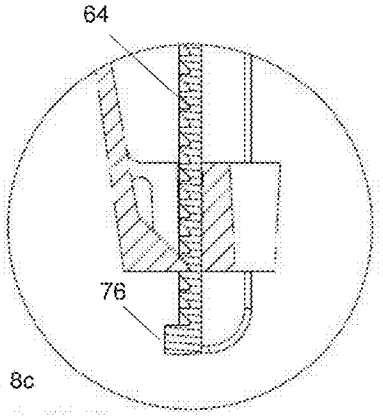

FIGS. 8*a*-8*c* illustrate operation of the carriage 24 from an unbiased position (middle) between an inwardly biased position (top) and an outwardly biased position (bottom) in accordance with one non-limiting aspect of the present invention. The unbiased position may correspond with the carriage 24 being unloaded or prior to holding the supporting member 18 where the pawl 66 may be in non-obstructive contact or non-retentive contact with one of the plurality of engagement elements 64 and/or slightly outwardly therefrom such that the carriage 24 is able to freely slide up and down the vertical bar 22. The unbiased position may orientate the pawl 66 inward of the end stop 76 to prevent the carriage 24 from being removed from the vertical bar 22 unless actuated to the inward bias position. The inward bias position may correspond with the user pressing inwardly on the flange 38 so as to pivot the pawl 66 beyond the end stop 76 whereupon the carriage 24 may be removed from the bottom end of the vertical bar 22. The outward bias position may correspond with the supported object 14 being retained in the pocket 42 or pressing down on surface 44 of the guide 40 and/or outwardly against the flange 38 such that the pawl 66 nests or is otherwise seated within one of the plurality of engagement elements 64 so as to prevent downward movement therefrom. The outward bias position may optionally be a normal or designed state of the guide 40 instead of the unbiased state such that the pawl 66 is always lodged within one of the plurality of engagement elements 64 unless pivoted out of engagement.

The guide 40 may include an inner passage 88 shaped to match a cross-section of the vertical bar 22 so as to permit the pawl 66 to actuate between the noted positions and to enable the carriage 24 to remain attached while sliding thereon. The vertical bar 22 may include a channel 90 (see FIGS. 5*a*-5*f*) on a backside along the body portion 62 opposite to the engagement elements 64 to define a u-shaped cross-section. The u-shaped cross-section may match with a corresponding cross-section of the inner passageway 88 to respectively define a key and keyway combination where the two shapes operate to insure one-way, proper positioning and alignment of the pawl 66 relative to the engagement elements 64. The guide 40 may include an extension 92 sized to fit with the channel of the vertical bar to provide lateral support and guidance. The extension 92 may optionally include a recess 94, shown as v-shaped for exemplary purposes, to facilitate a pinching movement or flexing of the inner passageway 88 when bearing the weight of the supported object 14 or supporting member 18. The pinching movement may distribute at least part of the associated downward forces in a partially lateral direction against the sides of the vertical channel 90, which may beneficial in ameliorating or distributing the forces on the pawl 66 to the vertical bar 22 to enhance retention and/or to prevent slippage. The guide 40 may also include tapered or other purposely shaped sides 96, 98 to further facilitate the pinching movement when a force presses down on the guide 40.

Figure 9D:
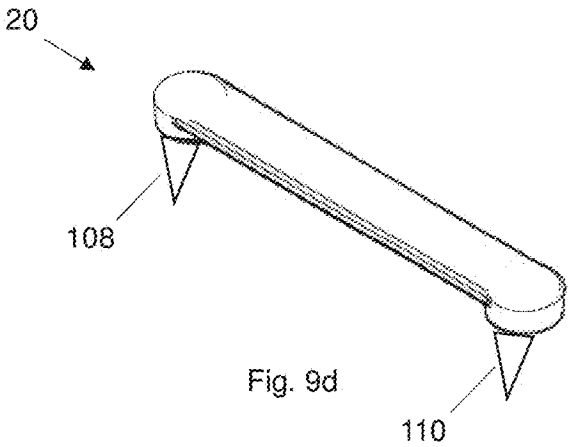
FIGS. 9*a*-9*d* illustrate optional configurations for the horizontal bar in accordance with various aspects of the present invention
Figure 9A:
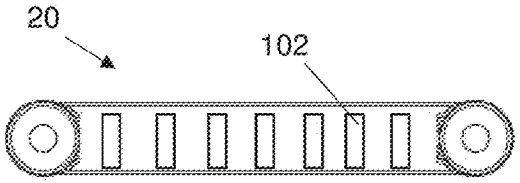
Figure 9B:
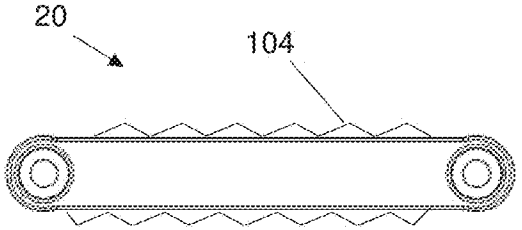
Figure 9C:
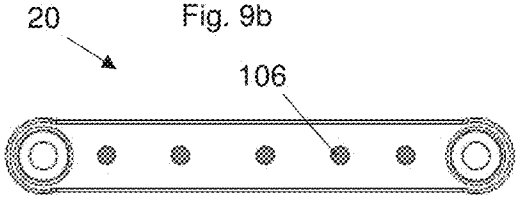
Figure 10B:
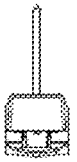
FIGS. 10*a*-10*g* illustrate a hanger in accordance with one non-limiting aspect of the present invention.
Figure 10A:
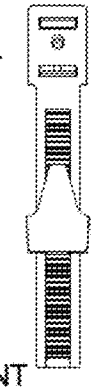
Figure 10C:
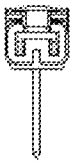
Figure 10D:
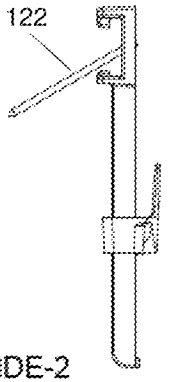
Figure 10E:
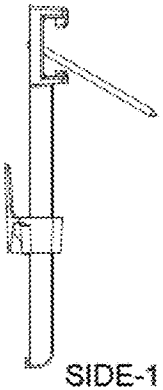
Figure 10F:
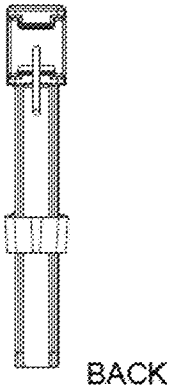
Figure 10G:
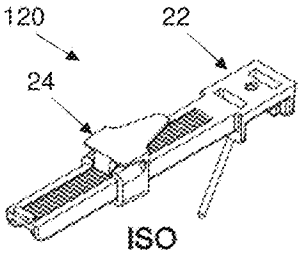

FIGS. 9*a*-9*d* illustrate optional configurations for the horizontal bar 20 in accordance with various aspects of the present invention. FIG. 9*a* illustrates lateral positioning elements 102 as protuberances or risers on a backside of the horizontal bar 20 provided in place of or in addition to the above-illustrated spines 80, 82. The protuberances 102 may be spaced to approximate a width of the first and second lips 52, 54 such that the first and second lips 52, 54 or lateral position components of the vertical bar 22 are locked therebetween to restrain the vertical bar 22 to a particular lateral position. FIG. 9*b* illustrates lateral positioning elements 104 as grooves or ridges on a top and/or bottom of the horizontal bar 20 that cooperate with the first and second lips 52, 54 or other lateral positioning components of the vertical bar 22 to restrain lateral positioning. FIG. 9*c* illustrates lateral positioning elements 106 as protuberances or risers on a front of the horizontal bar 20 that cooperate with the central portion 84 of the top portion 62 or other lateral position components of the vertical bar 22 to restrain lateral movement. FIG. 9*d* illustrates tabs, cones, hooks, etc. 108, 110 extending from a backside of the horizontal bar 20 in place of or in addition to the above-illustrated fasteners 28, 30. The tabs 108, 110 may be configured to engage the supporting surface 16 or to attach to openings or reliefs so as to facilitate mounting the horizontal bar 20 thereto optionally without the fasteners 28, 30.

Figure 11:
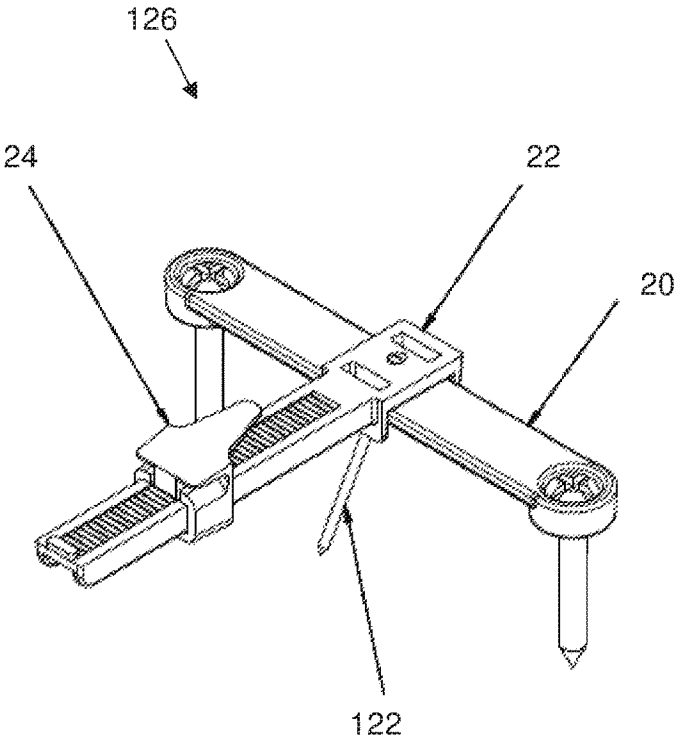
FIG. 11 illustrates a hanger in accordance with one non-limiting aspect of the present invention.
Figure 12A:
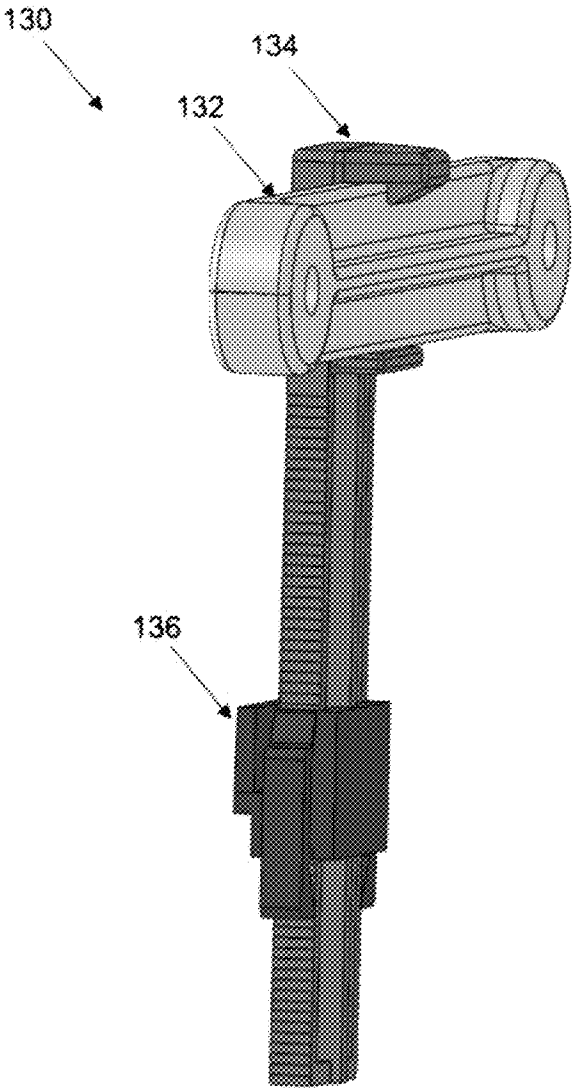
FIGS. 12*a*-12*f* illustrate a hanger system in accordance with one non-limiting aspect of the present invention.
Figure 12B:
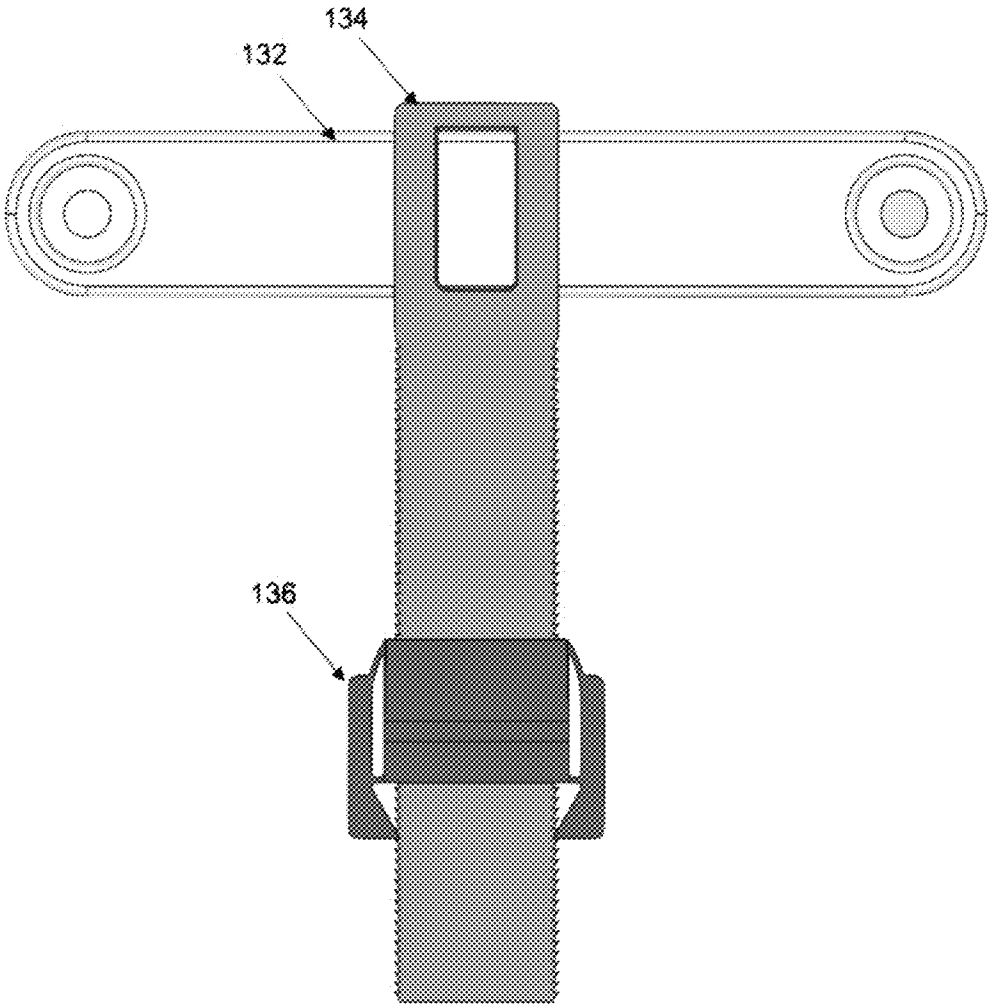
Figure 12C:
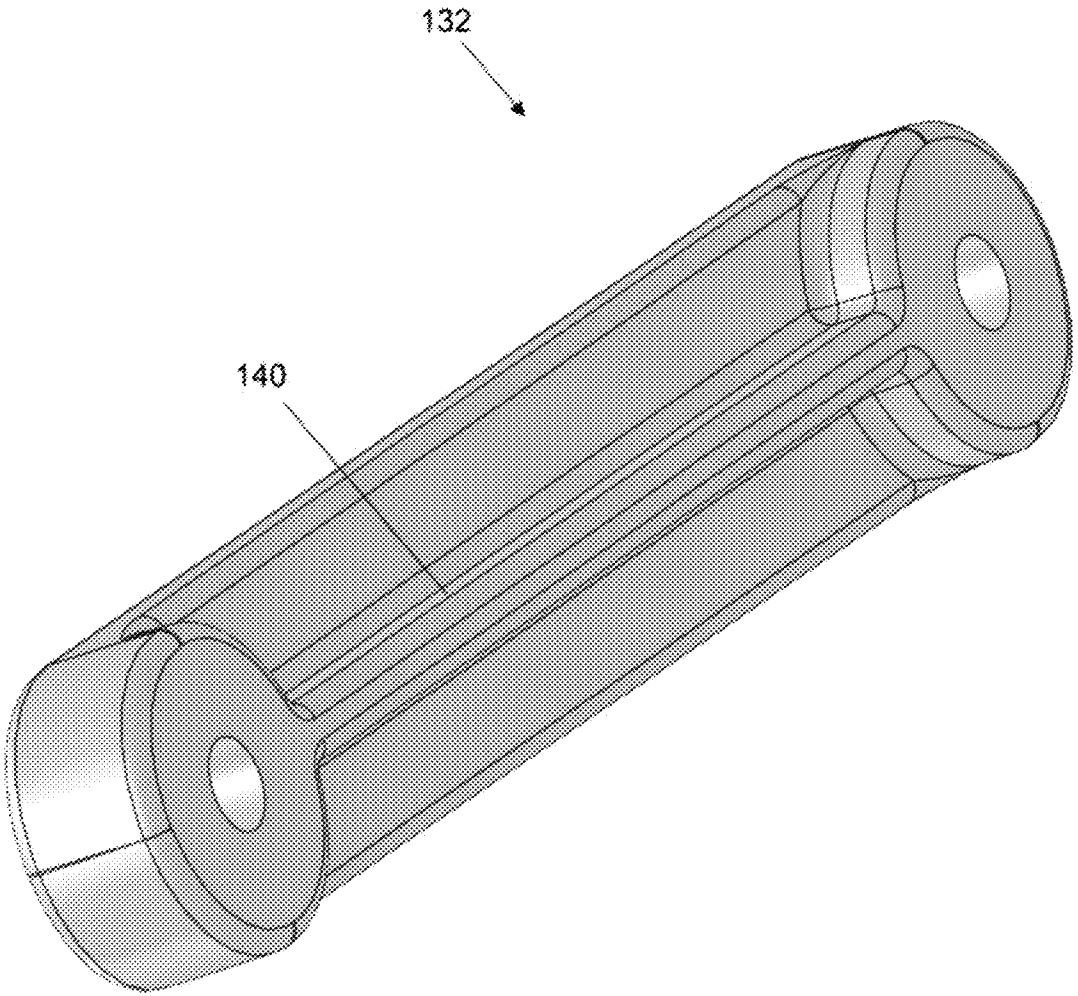
Figure 12D:
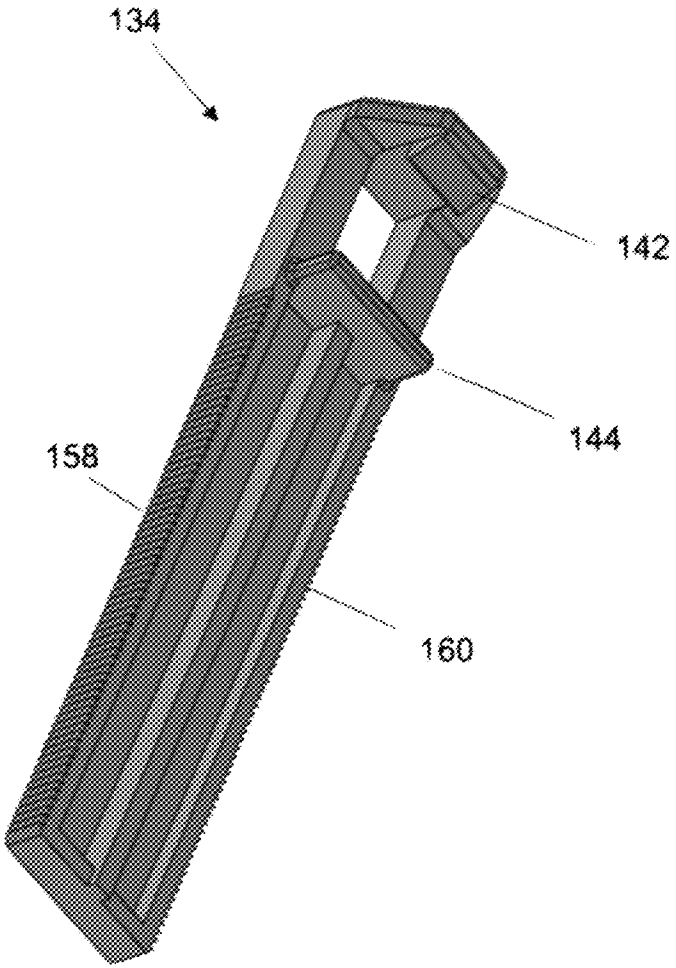
Figure 12F:
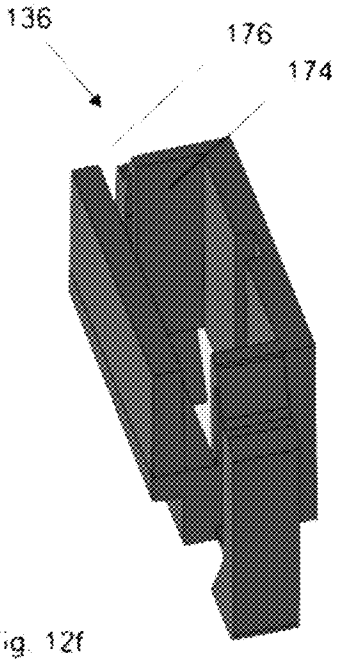
Figure 12E:
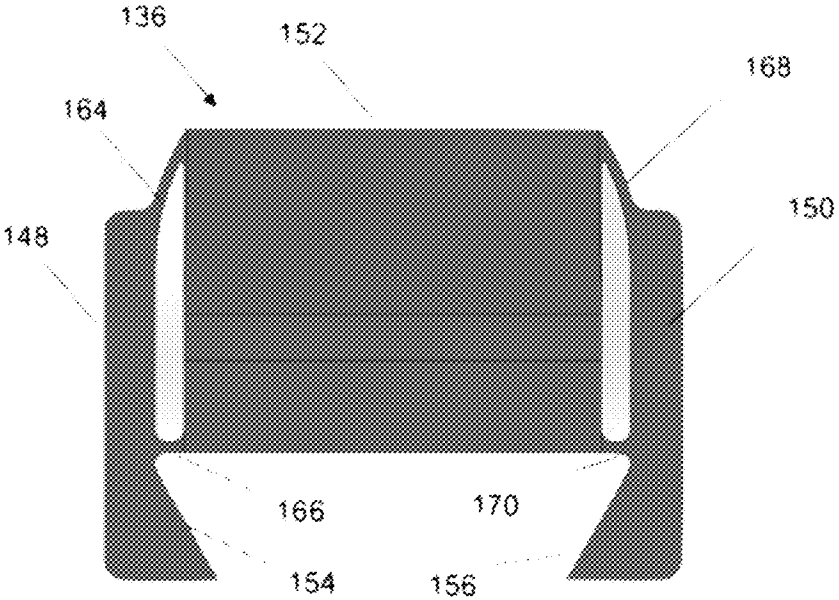

FIGS. 10*a*-10*g* illustrate a hanger system 120 in accordance with one non-limiting aspect of the present invention. The hanger 12 is shown to include the above-described vertical bar 22 and carriage 24 with a nail or other fastener 122 being driven through the aperture included in the top portion. The carriage may be configured in the above-described manner to facilitate pinching or otherwise flexing to restrain movement in the downward direction along the vertical bar. FIG. 11 illustrates a hanger system 126 in accordance with one non-limiting aspect of the present invention where a nail 122 may be driven through the aperture in the vertical bar 22 and thereafter though the horizontal bar 20 into the supporting surface 16. The nail 122 may enhance mounting of the vertical bar 22 and prevent any lateral movement of the vertical bar 22, which may be beneficial to prevent further adjustments after the user re-positions the carriage 24 to the desired position. The hanger system 126 may also be configured to drive the nail into but not through the horizontal bar 20 and/or into recess included on the horizontal bar 20, such to non-permanently position a tong through the aperture and into a recess of the horizontal bar 20 that can be easily removed and re-positioned without damaging the supporting surface 16.

FIGS. 12*a*-12*f* illustrate a hanger system 130 in accordance with one non-limiting aspect of the present invention. The hanger system 120 is shown to include a horizontal bar 132, a vertical bar 134 and a carriage 136 configured to facilitate multi-way movement and re-positioning similar to the hanger 12 shown in FIG. 2. A spine 140 on a back of the horizontal bar 132 is shown to cooperate with a lip and ledge 142, 144 on a top portion of the vertical bar 134 to facilitate clipping the vertical bar 134 thereto in a sliding arrangement. The carriage is shown to include multiple flanges 148, 150 and may be operable relative to a guide 152 to pivot corresponding pawls 154, 156 into and out of engagement with corresponding engagement elements 158, 160 included on lateral sides of the vertical bar 134 to securely position the carriage 136. The carriage 136 is shown to include top and bottom hinges 164, 166, 168, 170 to facilitate movement of the pawls 154, 156 but may be similarly operable with a single one of the top and bottom hinges 164, 166, 168, 170. The carriage 136 may include an inner passageway 174 shaped to match a cross-section of the vertical bar 134 to provide lateral integrity and one-way assembly. The carriage 134 may be sized to form a pocket 176 for receiving the supporting member 18 whereby the supporting member 18 seats between opposed walls of the guide 152 instead of between the flange and vertical bar as described above.

FIGS. 13*a*-13*f* illustrate a hanger system 200 in accordance with one non-limiting aspect of the present invention. The hanger system 200 is shown to include a vertical bar 202 and a carriage 204 configured to facilitate multi-way movement and re-positioning of a picture or other hung structure similar to the hanger 12 shown in FIG. 2. The hanger system 200 may be configured to engage a sawtooth support 206 or other element attached to a backside of a picture desired for mounting to a wall (not shown—leftward of the carriage 204 shown in FIG. 13*f*). The carriage 204 may be shaped differently than the carriage 24 described above to include sides 208, 210 extending upwardly to form a top ledge or surface 212 having included thereon a tab 214 shaped to journal or otherwise engage within recesses of the support 206. The tab 214 may be sized and shaped to match the v-shaped recesses or other openings included in the support 206, i.e., include a rearward extending portion (not shown) shaped to fit within the fee-shaped recesses. The surface 212 may extend over the vertical bar 202 to provide limit on downward movement of the carriage 204 relative thereto. The carriage 204 may include a guide 220 similar to the guide 40 described above to facilitate positioning the carriage relative to the vertical bar 202, e.g., relative to the upper position shown in FIG. 13*e*, the downward position shown in FIG. 13*e* or at any position therebetween.

Figures 13E, 13F:
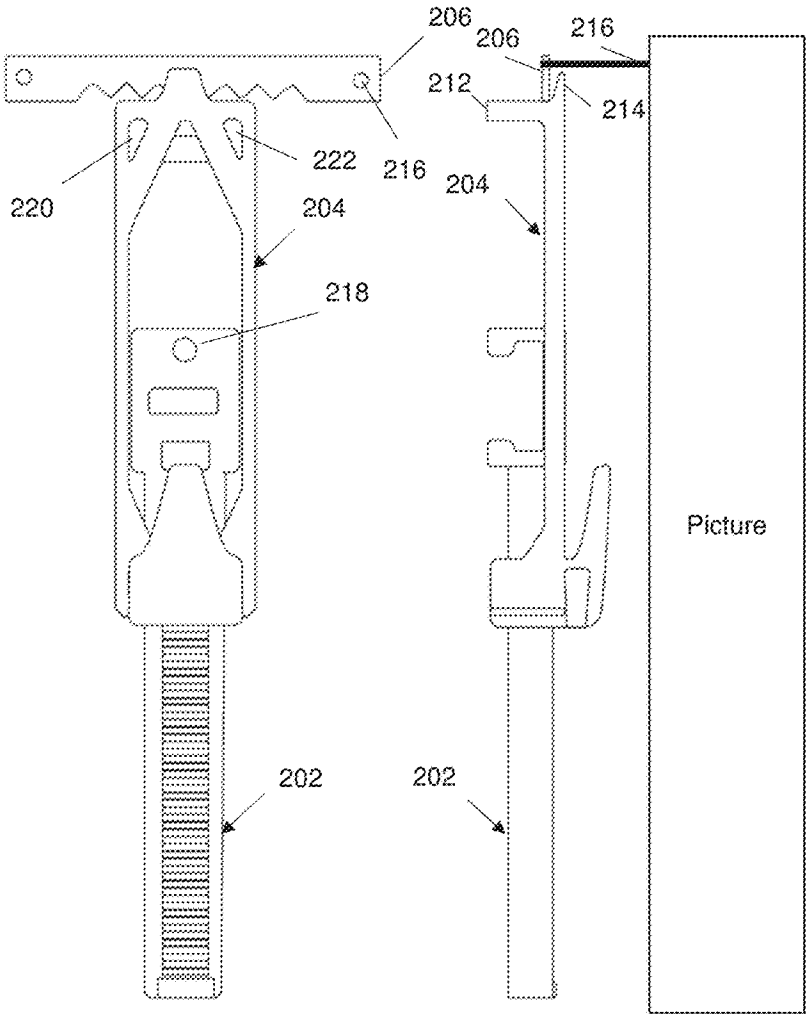

The support structure 206 may include a nail 216 or other fastener having a length sufficient to offset the picture from the carriage 204 by an amount greater than the guide 220 to facilitate inserting the hanger system 200 between the picture and the wall (the picture is omitted from FIG. 13*e*). The vertical bar 202 may be nailed to the wall through an aperture 218 whereafter the picture may be vertically positioned along the vertical bar 202 with movement of the guide 220 and/or horizontally positioned along the tab 214 with the support 206. Optionally, the above described horizontal bar 20 (not shown) may be nailed or fixed to the wall initially with the vertical bar 220 being attached thereafter, i.e., to enable vertical positioning via the vertical bar 202, horizontal positioning via the horizontal bar 20 and additional horizontal positioning via the support 206. The carriage 204 may include one or more apertures 220, 222 through which nails or other fasteners (not shown) may be driven to further secure the carriage 204 to the wall. One non-limiting aspect of the present invention contemplates the carriage 204 being sufficient to initially support and facilitate orientating the picture relative to the wall such that fasteners may be driven thereafter through the apertures 220, 222 after desired positioning of the picture is obtained, i.e., to permanently secure the hanger system 200 after temporarily positioning.

The adjustable hanger is a picture perfect hanger that will allow the user to hang items such as, but not limited to, pictures, photographs, artwork, wall decorations and all items similar which require a mounting unit attached to the wall to support the weight of the item which is to be hung. The picture perfect hanger allows a user to adjust the height and horizontal position of the item being hung simply by sliding the support hook up or down the track and laterally left and right. While other "picture hangers" require precise measurements to position the hung item at the desired position, the picture perfect hanger allows the user to reposition the hung item, up or down, without having to re-nail the hanging hook. The item can be adjusted up or down to within 1/32 of an inch. No more pounding several nail holes into the wall to finally end up with the hung item at the desired height.

To use the picture perfect hanger, simply determine where you want to hang an item on the wall or mounting surface. Pound the provided nail through the holes in the horizontal bar into the surface so the nail head is flush with the plastic vertical rail of the picture perfect hanger. Using whatever support mechanism, most commonly wire, or frame brackets, which have been attached to the item you wish to hang, place the item to be hung on the picture perfect hanger. If the hung item is too high or too low simply lift it off the picture perfect hanger, and adjust the item up or down to desired height. The item can always be re-adjusted at any time by simply sliding the hook of the perfect picture hanger up or down. While the use of horizontal and vertical bar is predominately described, the bar need not be so elongated or straight and need not join together at a right angle or otherwise be perpendicular in order to provide the multi-way adjustability contemplated by the present invention.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A four-way adjustable picture hanger comprising:

a horizontal bar configured to facilitate mounting to a support surface;

a vertical bar having a top portion and a bottom portion, the top portion configured to cooperate with the horizontal bar in a manner sufficient to permit the vertical bar to remain attached while sliding thereon in a first way and a second way, the first way being characterized as leftward when toward a left side of the horizontal bar and the second way being characterized as rightward when toward a right side of the horizontal bar, the bottom portion extending downwardly from the top portion and including a plurality of engagement elements;

a carriage having a flange pivotally connected to a guide, the flange configured to cooperate with the guide in a manner sufficient to permit the carriage to remain attached to the vertical bar while sliding thereon in a third way and a fourth way, the third way being characterized as upward when toward an upper end of the vertical bar and the fourth way being characterized as downward when toward a bottom end of the vertical bar, the flange being configured to pivot about the guide in a manner sufficient to facilitate engaging one of the plurality of engagement elements so as to obstruct the carriage from sliding downward therefrom when the carriage supports a picture or other weighted element; and wherein the horizontal bar, the vertical bar and the carriage are corresponding shaped such that at least a portion of a back side of each rests against the support surface when the carriage supports the picture or other weighted element.

2. The hanger of claim 1 wherein the horizontal bar is elongated and includes a first mounting element at one distal end and a second mounting element at another distal end, the first and second mounting elements being configured to facilitate mounting the horizontal bar to the support surface.

3. The hanger of claim 2 wherein the first and second mounting elements are recessed apertures shaped to each respectively counter-sink a fastener used to mount the horizontal bar to the support surface.

4. The hanger of claim 3 wherein the body portion includes a recessed, diagonal aperture shaped to counter-sink a nail such that the nail drives diagonally through the horizontal bar and then into the support surface when used to enhance mounting of the horizontal bar.

5. The hanger of claim 2 wherein the horizontal bar includes one or more lateral positioning elements between the first and second mounting elements, the lateral positioning elements being configured to engage one or more lateral positioning components on the vertical bar in a manner sufficient to restrain the vertical bar from laterally sliding thereon unless each of the lateral position elements is sufficiently disengaged from each of the lateral positioning components.

6. The hanger of claim 5 wherein the lateral positioning elements are grooves included on at least one of a top side and a bottom side of the horizontal bar.

7. The hanger of claim 5 wherein the lateral positioning elements are protuberances included on a front side of the horizontal bar.

8. The hanger of claim 1 wherein:

the top portion of the vertical bar includes a clamp configured to releasable snap top and bottom lips respectively around top and bottom sides of the horizontal bar; and a back side of the horizontal bar includes at least one elongated spine offset inwardly from the top and bottom sides, each elongated spine being shaped relative to the top and bottom lips so as to press against the support surface when the carriage supports the picture or other weighted element.

9. A four-way adjustable picture hanger comprising:

a horizontal bar configured to facilitate mounting to a support surface;

a vertical bar having a top portion and a bottom portion, the top portion configured to cooperate with the horizontal bar in a manner sufficient to permit the vertical bar to remain attached while sliding thereon in a first way and a second way, the first way being characterized as leftward when toward a left side of the horizontal bar and the second way being characterized as rightward when toward a right side of the horizontal bar, the bottom portion extending downwardly from the top portion and including a plurality of engagement elements;

a carriage having a flange pivotally connected to a guide, the flange configured to cooperate with the guide in a manner sufficient to permit the carriage to remain attached to the vertical bar while sliding thereon in a third way and a fourth way, the third way being characterized as upward when toward an upper end of the vertical bar and the fourth way being characterized as downward when toward a bottom end of the vertical bar, the flange being configured to pivot about the guide in a manner sufficient to facilitate engaging one of the plurality of engagement elements so as to obstruct the carriage from sliding downward therefrom when the carriage supports a picture or other weighted element; and wherein a back side of the vertical bar at the top portion includes first and second lips shaped to extend inwardly over a top side and a bottom side of the horizontal bar in a manner sufficient to clip the vertical bar thereto.

10. The hanger of claim 9 wherein:

the back side of the vertical bar at the bottom portion includes a channel defining a u-shaped cross-section for the vertical bar; and the guide includes an inner passageway shaped to match the u-shaped cross-section of the vertical bar, the inner passageway cooperating with the channel to provide slide-n-glide operation, including preventing the guide from being disengaged from the vertical bar unless slid past the bottom end thereof.

11. The hanger of claim 10 wherein the back side of the guide includes a v-shaped channel extending into the channel of the vertical bar and shaped to facilitate pinching opposed sides of the inner passageway toward the vertical bar when a wire or other loading-bearing hanging feature of the picture or weighted element rests against the guide in a pocket defined between the vertical bar and the flange.

12. The hanger of claim 10 wherein the plurality of engagement elements are recessed grooves included on a front side of the vertical bar opposite to the back side, the vertical bar including flat rails on opposed sides of the grooves to facilitate sliding the carriage thereon.

13. The hanger of claim 1 wherein:

a hinge is configured to pivot the flange about the guide from an unbiased position between an inwardly biased positioned and an outwardly biased position; and a pawl included on the flange:

i) engages at least one of the plurality of engagement elements when the flange is in the outwardly biased position to prevent the carriage from sliding downward therefrom;

ii) disengages from each of the plurality of engagement elements when the flange is in the inwardly biased position to enable the guide to freely slide-n-glide along the vertical bar, the inward biased position being sufficient to enable the guide to slide past an end stop at a bottom end of the vertical bar; and iii) disengages from each of the plurality of engagement elements when the flange is in the unbiased position in manner sufficient to enable the carriage to slide-n-glide along the vertical bar, the unbiased position being insufficient to enable the guide to slide past the end stop.

14. The hanger of claim 1 wherein:

the vertical bar is positioned within an inner passageway of the guide when the carriage is connected thereto, the inner passageway being shaped so as to orientate a pawl included on the flange relative to the plurality of engagements elements, the pawl being shaped to pivot with the flange in a manner sufficient to facilitate engaging and disengaging the plurality of engagement elements; and wherein the guide includes a channel shaped to facilitate pinching opposed sides of the inner passageway toward the vertical bar when a wire or other loading-bearing hanging feature of the picture or weighted element rests against the guide in a pocket defined between the vertical bar and the flange.

15. A hanger comprising:

a horizontal bar having a mounting element configured to facilitate mounting to a support;

a vertical bar configured to remain attached to the horizontal bar while sliding thereon; and a carriage configured to remain attached to the vertical bar while sliding thereon, the carriage being configured to selectively engage one of a plurality of engagement elements included on the vertical bar so as to obstruct the carriage from sliding downward therefrom when bearing a weight of an object hung therefrom.

16. The hanger of claim 15 wherein the vertical bar slides through an inner passageway of the carriage constructed to flex from a non-flexed position occurring prior to the object being hung therefrom to a flexed position when the object is hung therefrom, the flexed position causing the inner passageway to pinch against the vertical bar.

17. The hanger of claim 16 wherein the inner passageway is shaped to orientate a pawl included on the carriage relative to the plurality of engagements elements, the pawl being configured to pivot to facilitate engaging and disengaging the plurality of engagement elements, the pawl pivoting to engage one of the engagement elements when the object is hung from the carriage.

18. The hanger of claim 17 wherein the carriage includes a recess shaped to receive and support a wire affixed to the object, the recess being sufficient to retain the wire while the carriage slides along the vertical bar and while the vertical bar slides along the horizontal bar.

19. The hanger of claim 9 wherein:

the vertical bar is positioned within an inner passageway of the guide when the carriage is connected thereto, the inner passageway being shaped so as to orientate a pawl included on the flange relative to the plurality of engagements elements, the pawl being shaped to pivot with the flange in a manner sufficient to facilitate engaging and disengaging the plurality of engagement elements; and wherein the guide includes a channel shaped to facilitate pinching opposed sides of the inner passageway toward the vertical bar when a wire or other loading-bearing hanging feature of the picture or weighted element rests against the guide in a pocket defined between the vertical bar and the flange.

* * * * *